US007374018B1

(12) United States Patent
Thrun

(10) Patent No.: US 7,374,018 B1
(45) Date of Patent: May 20, 2008

(54) ADJUSTABLE TOOL TRAY FOR LADDERS AND THE LIKE

(76) Inventor: David C. Thrun, 3001 Springport Rd., Jackson, MI (US) 49201

( * ) Notice: Subject to any disclaimer, the term of this patent is extended or adjusted under 35 U.S.C. 154(b) by 208 days.

(21) Appl. No.: 11/232,402

(22) Filed: Sep. 22, 2005

(51) Int. Cl.
*E06C 5/00* (2006.01)

(52) U.S. Cl. ..... 182/129; 248/238

(58) Field of Classification Search ..... 182/129; 248/210, 211, 238, 229.12, 229.14, 229.22, 248/229.24, 228.3, 228.5, 231.41, 231.61
See application file for complete search history.

(56) References Cited

U.S. PATENT DOCUMENTS

| | | | | |
|---|---|---|---|---|
| 3,822,847 | A | 7/1974 | Emmons | |
| 3,938,619 | A * | 2/1976 | Kurabayashi et al. | 182/113 |
| 4,445,659 | A | 5/1984 | LaChance | |
| 4,480,810 | A | 11/1984 | Hall | |
| 4,949,925 | A | 8/1990 | Gorecki | |
| D361,664 | S | 8/1995 | Brown | |
| 5,836,557 | A * | 11/1998 | Bailey et al. | 248/210 |
| 6,698,548 | B1 * | 3/2004 | Verrill | 182/129 |
| 7,063,187 | B1 * | 6/2006 | Lavigne | 182/129 |
| 2005/0258002 | A1 * | 11/2005 | Sabo | 182/129 |
| 2006/0137937 | A1 * | 6/2006 | Pratt | 182/129 |

* cited by examiner

*Primary Examiner*—Alvin C Chin-Shue

(57) ABSTRACT

A storage unit includes a tray including a bottom surface and sidewalls connected to an outer perimeter of the bottom surface. The tray has an open top surface in fluid communication with the ambient surroundings. The sidewalls extend upward from the bottom surface and are registered perpendicular thereto. Opposed sidewalls are provided with equidistantly spaced notches formed therein that extend along a length of the tray. Corresponding notches are aligned along the opposed sidewalls. Coextensive and linear dividers are positioned into the notches and define isolated chambers. A mechanism is included for conjoining the tray to a ladder rung such that the tray becomes situated along a horizontal plane on top of the ladder rung. The conjoining mechanism is spaced from the dividers and the bottom surface of the tray respectively.

5 Claims, 2 Drawing Sheets

ADJUSTABLE TOOL TRAY FOR LADDERS AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tool trays and, more particularly, to an adjustable tool tray for ladders and the like.

2. Prior Art

In the past, persons who work from extension ladders have had difficulty storing and/or handling all of the items they required for completing the tasks they set out to accomplish. Such persons often were inconvenienced in having to make multiple trips up and down the extension ladder to retrieve a particular tool or the like, or to replace one tool with another, because of the lack of convenient storage for such tools up on the ladder, at the workplace. Furthermore, when the ladder is placed at an angle to the wall or other object for support, it is desirable to be able to adjust the work surface to be substantially horizontal or level, regardless of the particular angle between the ladder and the wall.

Some fixed-position extension ladder shelves have been used in the past, but they have not been horizontally adjustable. Another problem is presented to the workman using an electric power tool from an extension ladder. Frequently, an extension cord is required to supply the necessary power, and often the workman must support not only the weight of the tool, but also the weight of the cord. This can be very tiring, awkward, or even dangerous for the workman. As the user's arm becomes tired of constantly suspending heavy equipment, the chance of dropping and damaging the tools greatly increases.

Accordingly, a need remains for an adjustable tool tray for ladders and the like in order to overcome the above-noted shortcomings. The present invention satisfies such a need by providing a ladder mounted tool tray that is easy and convenient to use, light weight and durable in design, is cost effective, and has time and labor saving qualities. Such a tool tray allows trades people, construction laborers, do-it-yourself enthusiasts etc. to have all the necessary tools at hand while performing a task at an elevated position on a ladder. The tools are advantageously organized and easily accessible and can be carried with ease. The storage features of the tool tray conveniently prevent expensive tools from falling from a ladder and being damaged.

BRIEF SUMMARY OF THE INVENTION

In view of the foregoing background, it is therefore an object of the present invention to provide an adjustable tool tray for ladders and the like. These and other objects, features, and advantages of the invention are provided by a tool supporting storage unit that is directly engageable along selected portions of an existing ladder.

The storage unit includes a tray including a planar bottom surface and a plurality of monolithically formed sidewalls directly connected to an outer perimeter of the bottom surface. One of the sidewalls may be registered parallel to the ladder rung and seated adjacent thereto while the opposed sidewalls traverse over the ladder rung and terminate at a predetermined distance oppositely spaced from the ladder rung. Such a one sidewall is oriented orthogonal to the opposed sidewalls. The tray has an open top surface in fluid communication with the ambient surroundings thereof. The sidewalls extend vertically upward from the bottom surface and are registered perpendicular thereto. Opposed ones of such sidewalls are provided with equidistantly spaced notches formed therein. The notches extend along a longitudinal length of the tray and corresponding ones of the notches are linearly aligned along the opposed sidewalls. Such notches further preferably extend vertically between top and bottom edges of the opposed sidewalls.

A plurality of coextensively shaped and linear dividers are removably positional directly into selected ones of the corresponding notches. Such dividers define a plurality of isolated and spaced chambers for conveniently and effectively housing the tools therein such that the tools advantageously remain separated during working conditions. The dividers may have a longitudinal axis registered orthogonal to a longitudinal axis of the rods. Such dividers have a longitudinal length substantially equal to a longitudinal length of the one sidewall.

A mechanism is included for conjoining the tray directly to a rung of the ladder such that the tray effectively becomes situated along a horizontal plane directly on top of the ladder rung. Such a conjoining mechanism is spaced from the dividers and the bottom surface of the tray respectively. The conjoining mechanism preferably includes a plurality of rectilinear rods slidably positional through the one sidewall and spaced laterally away from an outer edge of the ladder rung. At least one of the rods is provided with a plurality of apertures traversing a longitudinal length thereof. A spring-actuated locking clamp including a linear shaft is removably positional directly into a selected one of the apertures for advantageously and effectively maintaining the rods statically affixed to the one sidewall during working conditions.

An elongated platform has a longitudinal length equal to a latitudinal length of the tray. Such a platform is directly connected to a bottom end portion of each rod. The platform has a planar top surface traversing the ladder rung and seated therebeneath such that the top surface of the platform directly abuts a bottom surface of the ladder rung. Such a platform cooperates with the tray and maintains sufficient surface area contact along bottom and top walls of the ladder rung so that the tray is advantageously and effectively prohibited from oscillating beyond the horizontal plane. The platform may be spaced below the tray after the storage unit is conjoined directly to the ladder rung.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
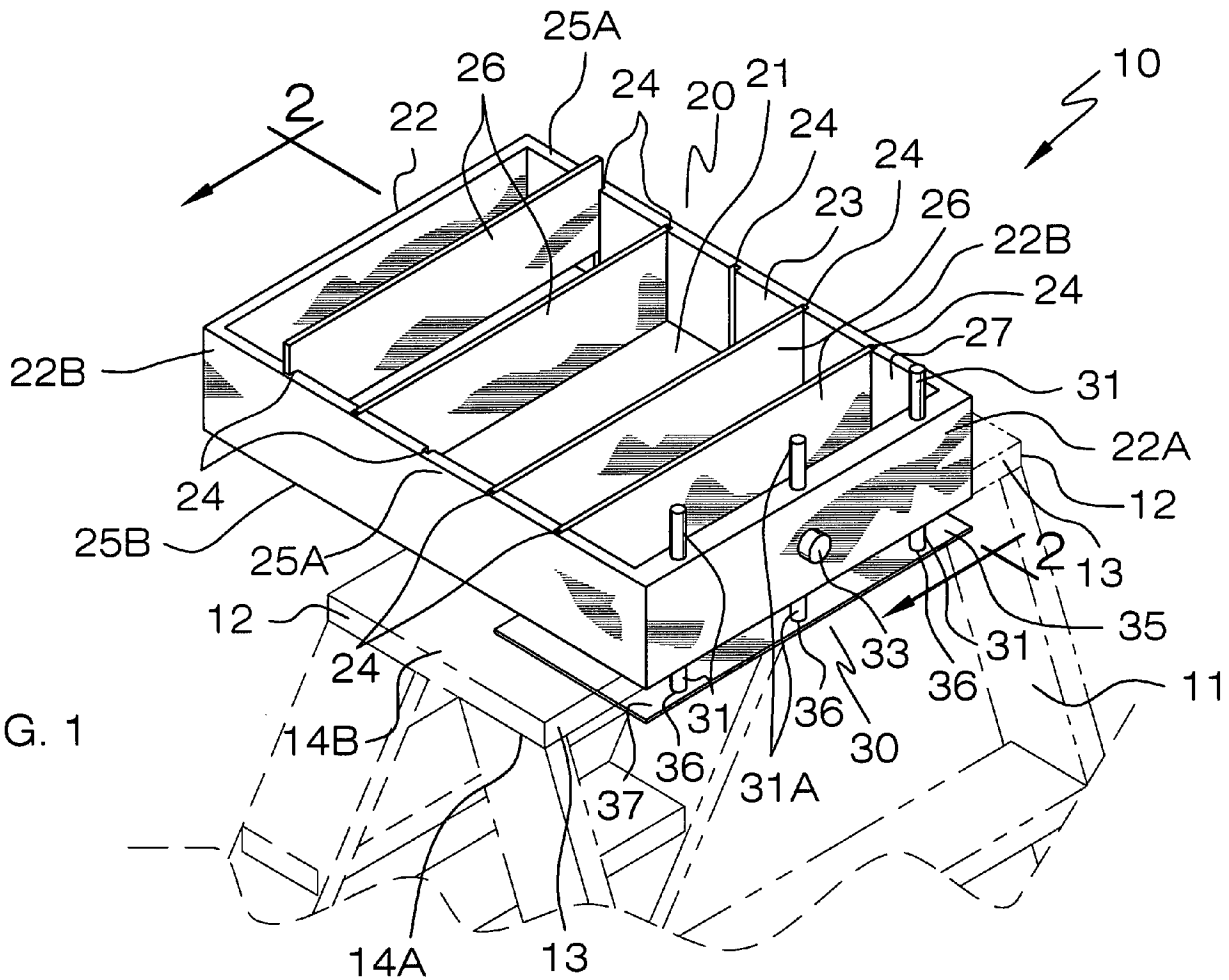
FIG. 1 is a perspective view showing an adjustable tool tray for ladders and the like, in accordance with the present invention.
Figure 2:
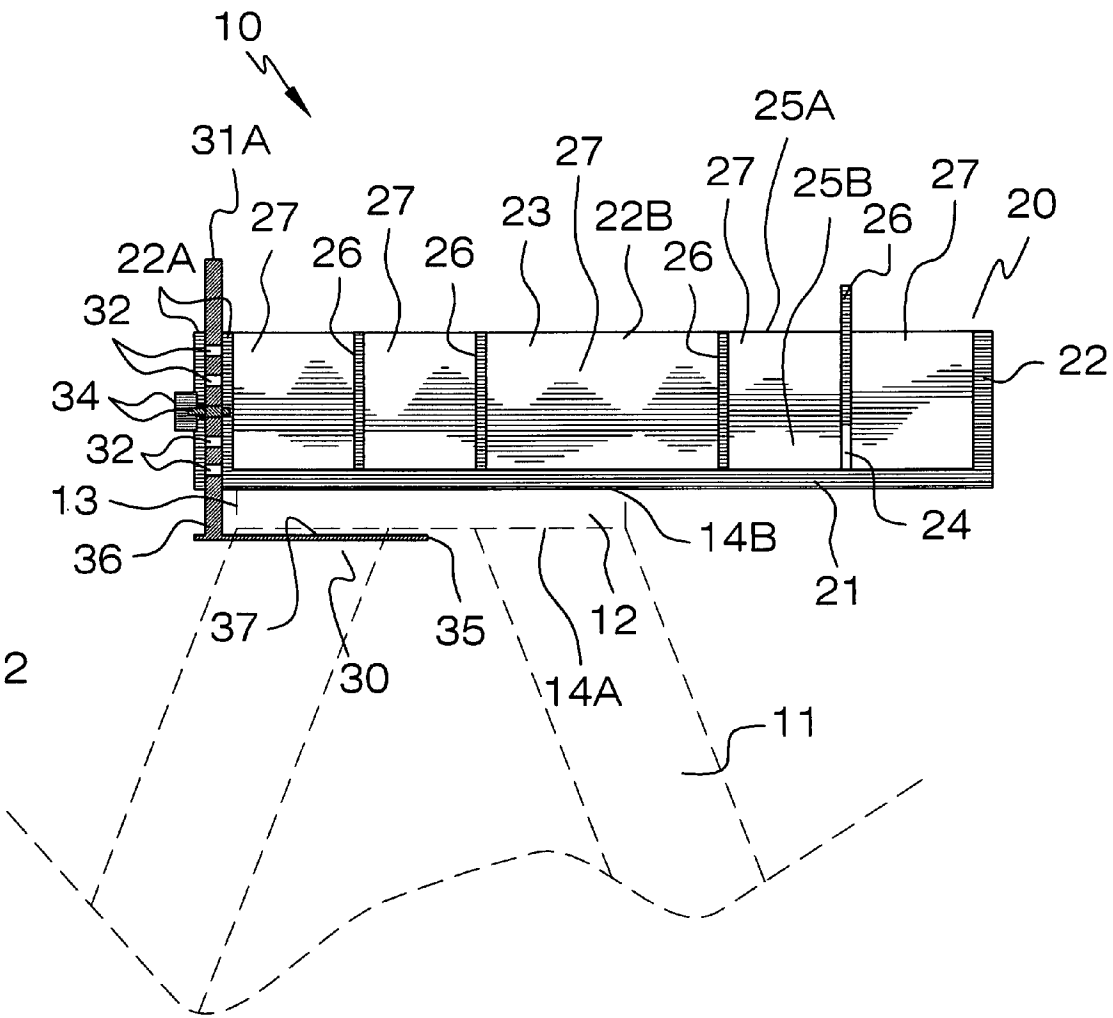
FIG. 2 is a cross-sectional view of the apparatus shown in FIG. 1, taken along line 2-2.

The apparatus of this invention is referred to generally in FIGS. 1-2 by the reference numeral 10 and is intended to provide an adjustable tool tray for ladders and the like. It should be understood that the apparatus 10 may be used to provide a tool tray in many different types of settings and should not be limited in use to only ladders.

Referring initially to FIGS. 1 and 2, the apparatus 10 includes a tray 20 including a planar bottom surface 21 and a plurality of monolithically formed sidewalls 22 directly connected, without the use of intervening elements, to an outer perimeter of the bottom surface 21. One of the sidewalls 22A is registered parallel to the ladder rung 12 and seated adjacent thereto while the opposed sidewalls 22B traverse over the ladder rung 12 and terminate at a predetermined distance oppositely spaced from the ladder rung 12. Such a one 22A sidewall is oriented orthogonal to the opposed sidewalls 22B.

The tray 20 has an open top surface 23 in fluid communication with the ambient surroundings thereof. Of course, the tray 20 may be provided with a hinged lid (not shown) for covering the open top surface 23, as is obvious to a person of ordinary skill in the art. The sidewalls 22 extend vertically upward from the bottom surface 21 and are registered perpendicular thereto. Opposed ones 22B of such sidewalls 22 are provided with equidistantly spaced notches 24 formed therein. The notches 24 extend along a longitudinal length of the tray 20 and corresponding ones of the notches 24 are linearly aligned along the opposed sidewalls 22B. Such notches 24 further extend vertically between top 25A and bottom 25B edges of the opposed sidewalls 22B.

Still referring to FIGS. 1 and 2, a plurality of coextensively shaped and linear dividers 26 are removably positional directly, without the use of intervening elements, into selected ones of the corresponding notches 24. Such dividers 26 define a plurality of isolated and spaced chambers 27 that are essential for conveniently and effectively housing the tools therein such that the tools advantageously remain separated during working conditions. This allows a person to more quickly identify a specific tool that they need, while also keeping the tools stored in an organized fashion. Of course, the dividers 26 and notches 24 may be alternately positioned so as to effectively form alternately shaped and sized chambers 27, as is obvious to a person of ordinary skill in the art. The dividers 26 have a longitudinal axis registered orthogonal to a longitudinal axis of the rods 31 (described herein below). Such dividers 26 also have a longitudinal length substantially equal to a longitudinal length of the one sidewall 22A.

Again referring to FIGS. 1 and 2, a mechanism 30 is included for conjoining the tray directly to a rung 12 of the ladder 11, without the use of intervening elements, such that the tray 20 effectively becomes situated along a horizontal plane directly on top, without the use of intervening elements, of the ladder rung 12. Such a conjoining mechanism 30 is spaced from the dividers 26 and the bottom surface 21 of the tray 20 respectively. The conjoining mechanism 30 includes a plurality of rectilinear rods 31 slidably positional through the one sidewall 22A and spaced laterally away from an outer edge 13 of the ladder rung 12.

At least one 31A of the rods 31 is provided with a plurality of apertures 32 traversing a longitudinal length thereof, as is best shown in FIG. 2. Such apertures 32 advantageously allows the apparatus 10 to be adapted for being attached to ladder rungs 12 having alternate widths, thus increasing the versatility thereof. A spring-actuated locking clamp 33 including a linear shaft 34 is removably positional directly, without the use of intervening elements, into a selected one of the apertures 32, which is crucial and advantageous for effectively maintaining the rods 31 statically affixed to the one sidewall 22A during working conditions.

Yet again referring to FIGS. 1 and 2, an elongated platform 35 has a longitudinal length equal to a latitudinal length of the tray 20. Such a platform 35 is directly connected, without the use of intervening elements, to a bottom end portion 36 of each rod 31. The platform 35 has a planar top surface 37 traversing the ladder rung 12 and is seated therebeneath such that the top surface 37 of the platform 35 directly abuts, without the use of intervening elements, a bottom surface 14A of the ladder rung 12. Such a platform 35 cooperates with the tray 20 and maintains sufficient surface area contact along bottom 14A and top 14B walls of the ladder rung 12, which is vital so that the tray is advantageously and effectively prohibited from oscillating beyond the horizontal plane. The platform 35 is spaced below the tray 20 after the storage unit 10 is conjoined directly, without the use of intervening elements, to the ladder rung 12.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A tool supporting storage unit directly engageable along selected portions of an existing ladder, said storage unit comprising:

a tray including a planar bottom surface and a plurality of monolithically formed opposed sidewalls and opposed end walls directly connected to an outer perimeter of said bottom surface, said tray having an open top surface in fluid communication with ambient surroundings, said sidewalls and end walls extending vertically upward from said bottom surface and registered perpendicular thereto, opposed ones of said sidewalls being provided with equidistantly spaced notches formed therein, said notches spaced along a longitudinal length of said tray and corresponding ones of said notches being linearly aligned along said opposed sidewalls;

a plurality of coextensively shaped and linear dividers removably positioned directly into selected ones of said corresponding notches, said dividers defining a plurality of isolated and spaced chambers for housing the tools therein such that the tools remain separated during working conditions; and means for conjoining said tray directly to a rung of the ladder such that said tray becomes situated along a horizontal plane and directly on top of the ladder rung;

wherein said conjoining means is spaced from said dividers and said bottom surface of said tray respectively;

wherein said conjoining means comprises a plurality of rectilinear rods slidably positioned through vertical through holes in one of said end walls and spaced laterally away from an outer edge of the ladder rung, at least a middle one said rods being provided with a plurality of apertures traversing a longitudinal length of said middle rod;

a spring-actuated locking clamp including a linear shaft connected to said one end wall and extending through a transverse hole in said one end wall and removably positioned directly into a selected one of said apertures for maintaining said rods statically affixed to said one end wall during working conditions; and an elongated platform having a longitudinal length equal to a width of said tray, said platform being directly connected to a bottom end of each said rods, said platform having a planar top surface traversing the ladder rung and seated therebeneath said top surface of said platform directly abuts a bottom surface of the ladder rung, said platform cooperating with said bottom surface of said tray and maintaining sufficient surface area contact along bottom and top walls of the ladder rung so that said tray is prohibited from oscillating beyond the horizontal plane;

wherein said platform is registered parallel to said bottom surface of said tray and the ladder rung respectively, said platform being monolithically formed with the bottom end of each said rods and further being registered orthogonal to each said rods;

wherein said platform and said bottom surface of said tray are prohibited from being vertically displaced away from the ladder rung when said platform is engaged with the bottom surface of the ladder rung;

wherein said platform has a linear anterior edge registered parallel to an anterior edge of said tray and remains spaced therebeneath while said storage unit is anchored to the ladder rung.

2. The storage unit of claim 1, wherein one said end wall is registered parallel to the ladder rung and seated adjacent thereto while said opposed sidewalls traverse over the ladder rung and terminate at a predetermined distance oppositely spaced from the ladder rung, said one end wall being oriented orthogonal to said opposed sidewalls.

3. The storage unit of claim 1, wherein said dividers have a longitudinal axis registered orthogonal to a longitudinal axis of said rods, said dividers having a longitudinal length substantially equal to a longitudinal length of said one sidewall.

4. The storage unit of claim 1, wherein said notches extend vertically between top and bottom edges of said opposed sidewalls.

5. The storage unit of claim 1, wherein said platform is spaced below said tray after said storage unit is conjoined directly to the ladder rung.

* * * * *